US005868026A

United States Patent [19]

Sarkisian et al.

[11] Patent Number: 5,868,026

[45] **Date of Patent: *Feb. 9, 1999**

[54] STEPPED, SEGMENTED, CLOSED-DIE FORGING

[75] Inventors: John M. Sarkisian, Northboro; John R. Palitsch; Joseph J. Zecco, both of Shrewsbury, all of Mass.

[73] Assignee: Wyman-Gordon Company, North Grafton, Mass.

[ * ] Notice: The term of this patent shall not extend beyond the expiration date of Pat. No. 5,592,847.

[21] Appl. No.: 663,056

[22] PCT Filed: Oct. 28, 1994

[86] PCT No.: PCT/US94/12412

§ 371 Date: Dec. 9, 1996

§ 102(e) Date: Dec. 9, 1996

[87] PCT Pub. No.: WO95/16528

PCT Pub. Date: Jun. 22, 1995

[51] Int. Cl.[6] ..... B21J 13/02

[52] U.S. Cl. ..... 72/356; 72/473

[58] Field of Search ..... 72/343, 352, 353.2, 72/356, 360, 373, 374, 377, 403, 404, 413, 473

[56] References Cited

U.S. PATENT DOCUMENTS

| | | |
|---|---|---|
| 1,116,181 | 11/1914 | Weber . |
| 1,449,385 | 3/1923 | Dieterich . |
| 1,560,135 | 11/1925 | Bell . |
| 3,443,412 | 5/1969 | Webb . |
| 3,521,472 | 7/1970 | Bringewald . |
| 3,575,035 | 4/1971 | Nokes . |
| 3,638,471 | 2/1972 | Martin . |
| 3,750,450 | 8/1973 | Sharp et al. . |
| 3,768,296 | 10/1973 | Pollak . |
| 3,847,004 | 11/1974 | Bringewald . |
| 4,023,389 | 5/1977 | Dibble et al. . |
| 4,051,708 | 10/1977 | Beane et al. . |
| 4,055,975 | 11/1977 | Serfozo et al. . |
| 4,074,559 | 2/1978 | Beane et al. . |
| 4,096,730 | 6/1978 | Martin . |
| 4,391,118 | 7/1983 | Martin . |
| 4,516,299 | 5/1985 | Martin . |
| 4,580,431 | 4/1986 | Oku et al. . |
| 4,803,880 | 2/1989 | Hopkins et al. . |
| 5,000,021 | 3/1991 | Nakamura et al. . |
| 5,249,451 | 10/1993 | Aranovsky et al. . |
| 5,592,847 | 1/1997 | Sarkisian et al. . |

FOREIGN PATENT DOCUMENTS

| | | |
|---|---|---|
| 1-289531 | 11/1989 | Japan . |
| 249906 | 8/1969 | U.S.S.R. . |
| 2129724 | 5/1984 | United Kingdom . |

*Primary Examiner*—Lowell A. Larson
*Attorney, Agent, or Firm*—Blodgett & Blodgett, P.C.

[57] ABSTRACT

This invention is a system for enhancing the performance of a forging press by increasing the size of the workpiece which can be effectively forged within the capacity of the forging press. The system includes the provision of a die set in which one or more of the dies is segmented, that is divided into two or more, and preferably three or more parts. The segmented die is provided with advancement means which allow each of the segments to be selectively advanced ahead of the other segments along the forging axis. The dies are installed in the forging press by mounting each die directly or indirectly to a respective die bed. In advancement means is employed to cause one of the segments to advance and be locked ahead of another segment. The workpiece is forged so that the advanced segment is a primary forging agent, that is, it transfers the vast majority of the force to the workpiece. The non-advanced segments are secondary forging agents, that is, they act only to control the reaction of other portions of the workpiece. Subsequently, the role of the segments is reversed, in steps, so that the formerly non-advance segment is advanced beyond the formerly advanced segment. The process of forging is then carried out again with the newly advanced segment or segments acting as the primary forging agent. By conducting this closed-die forging operation in this stepped manner with a segmented die, the total effective force is applied serially over several sections of the workpiece so that each section of the workpiece is effectively exposed to a greater forging pressure and, therefore, more forging work can be done on the workpiece. Conversely, a given available forging force can be used to form a greater size of workpiece.

41 Claims, 14 Drawing Sheets

STEPPED, SEGMENTED, CLOSED-DIE FORGING

STATEMENT REGARDING FEDERALLY SPONSORED RESEARCH OR DEVELOPMENT

This invention has been created without the sponsorship or funding of any federally sponsored research or development program.

CROSS REFERENCE TO RELATED APPLICATIONS

This application is the National Stage under 35 USC 371 of PCT International Application PCT/US94/12412, filed, 28 Oct., 1994. It is related to U.S. application Ser. No. 08/783,551 filed 14 Jan., 1997, which is a continuation of U.S. application Ser. No. 08/467,159, filed 6 Jun., 1995, now U.S. Pat. No. 5,592,847, which was a continuation of U.S. application Ser. No. 08/169,300, filed 17 Dec., 1993, now abandoned.

FIELD OF THE INVENTION

This invention is concerned with the forging of large workpieces of metal and the like, especially large structural parts.

BACKGROUND OF THE INVENTION

When forging large structural parts for aerospace and similar applications, the total force of the forging press generally places an upper limit on the plan area of the workpiece. Once this upper limit of plan area has been reached for a given available press, the formation of structural parts of larger sizes generally requires that the part be forged in separate pieces and then assembled into a finished large part. The increasing sophistication of aircraft design and other similar technologies has increased the demand for larger and larger structural parts. On the other hand, the limit on the economic availability of large-force forging presses and the serious economic and practical problems of joining smaller subelements together to form large forged pieces have created serious difficulties in manufacturing large forged structural parts. These and other difficulties experienced by the prior art have been obviated in a novel manner by the present invention.

It is, therefore, an outstanding object of the present invention to provide a system for increasing the size of workpieces which can be manufactured in a given forging press.

Another object of this invention is to provide a system by which a given workpiece can be forged using a smaller capacity forging press.

With these and other objects in view, as will be apparent to those skilled in the art, the invention resides in the combination of parts set forth in the specification and covered by the claims appended hereto.

SUMMARY OF THE INVENTION

This invention is a system for enhancing the performance of a forging press by increasing the size of the workpiece which can be effectively forged within the capacity of the forging press. The system includes the provision of a die set in which one or more of the dies is segmented, that is divided into two or more, and preferably three or more parts. The segmented die is provided with advancement means which allow each of the segments to be selectively advanced ahead of the other segments along the forging axis. The dies are installed in the forging press by mounting each die directly or indirectly to a respective die bed. In advancement means is employed to cause one of the segments to advance and be locked ahead of another segment. The workpiece is forged so that the advanced segment is a primary forging agent, that is, it transfers the vast majority of the force to the workpiece. The non-advanced segments are secondary forging agents, that is, they act only to control the reaction of other portions of the workpiece. Subsequently, the role of the segments is reversed, in steps, so that the formerly non-advance segment is advanced beyond the formerly advanced segment. The process of forging is then carried out again with the newly advanced segment or segments acting as the primary forging agent. By conducting this closed-die forging operation in this stepped manner with a segmented die, the total effective force is applied serially over several sections of the workpiece so that each section of the workpiece is effectively exposed to a greater forging pressure and, therefore, more forging work can be done on the workpiece. Conversely, a given available forging force can be used to form a greater size of workpiece. In the preferred embodiment, the segments would be selected for advancement in such a way that the area of the workpiece subject to the primary forging agents in each step remains symmetrical about the center of the forging axis. Furthermore, the segmented die would be enclosed in a segmented die holding frame which would maintain the segments together during the forging operation.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

Figure 1:
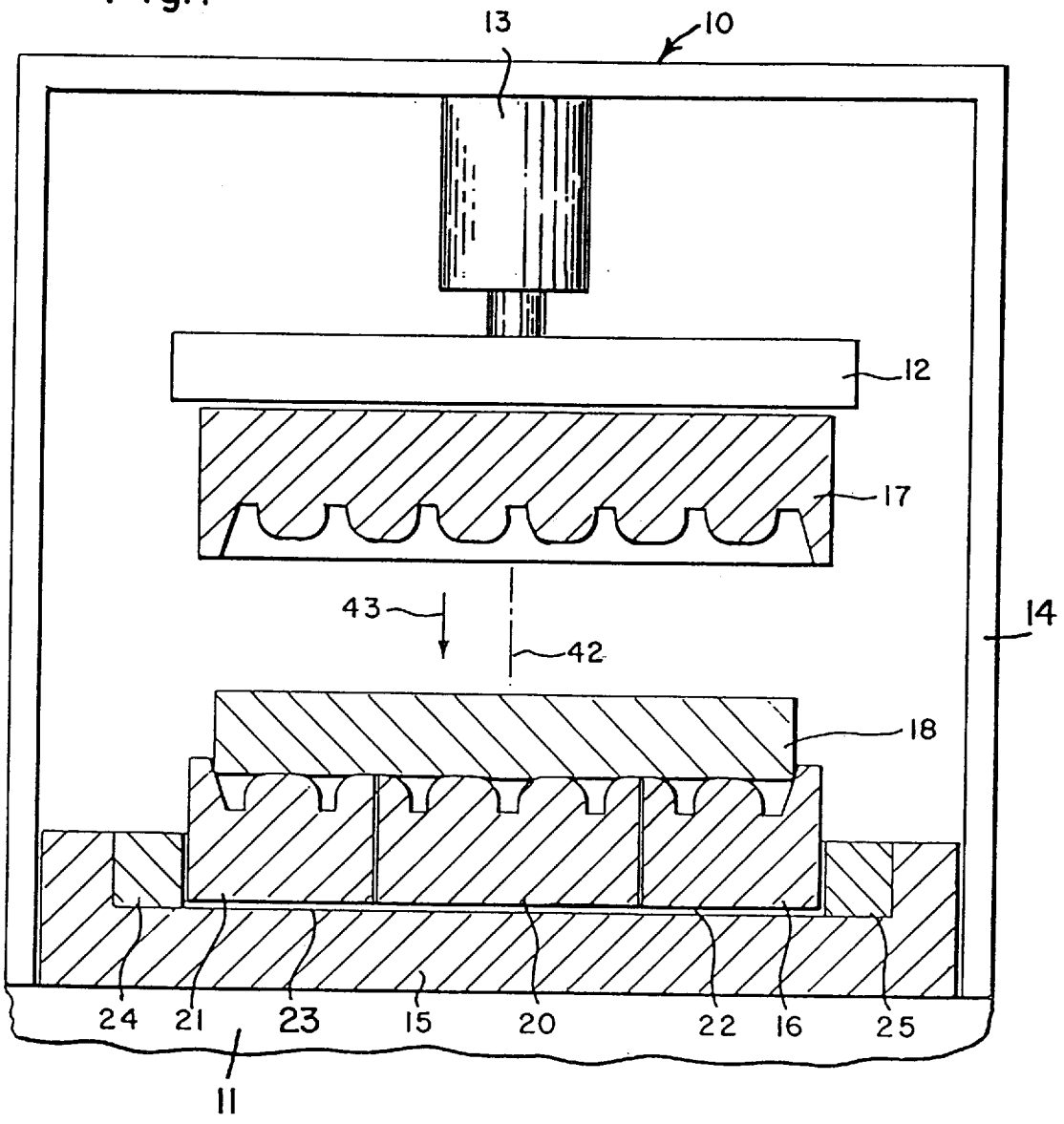
FIG. 1 is a front elevation view in partial section of a forging process embodying the principles of the present invention prior to application of the process of the present invention on the workpiece.

Referring first to FIG. 1 in which the general features of the present invention are shown, the forging system 10 of the present invention is shown to include a base or first die bed 11, which, in this embodiment, is stationary, and a movable or second die bed 12, which is moved by a forging actuator 13. The base die bed 11 and actuator 13 are locked together by a frame 14. A segmented die holder 15 is mounted on the stationary die bed 11 and a segmented die 16 is mounted in the segmented die holder 15. A non-segmented die 17 is mounted on the movable die bed 12.

FIG. 1 shows the configuration of the equipment prior to this particular process being carried out on the workpiece 18. At this point, the workpiece would typically be a rectilinear block of titanium or other high performance metal. In FIG. 1, the workpiece 18 is sitting on the impressioned face of the segmented die 16. In the embodiment shown in FIG. 1, the segmented die is formed of a first or central segment 20 and pair of lateral segments 21 and 22, positioned on opposite sides of the central segment. The segmented die is positioned in a cavity 23 in the upper face of the segmented die holder 15. The segmented die holder 15 is, in turn, mounted on the first die bed 11. The segmented die 16 is positioned within the cavity 23 and held in place by locks 24 and 25.

The actuator 13 moves the second or movable die bed 12 along a forging axis 42 and in a forging direction 43 which forces the two dies 16 and 17 into a closed position.

Figure 2:
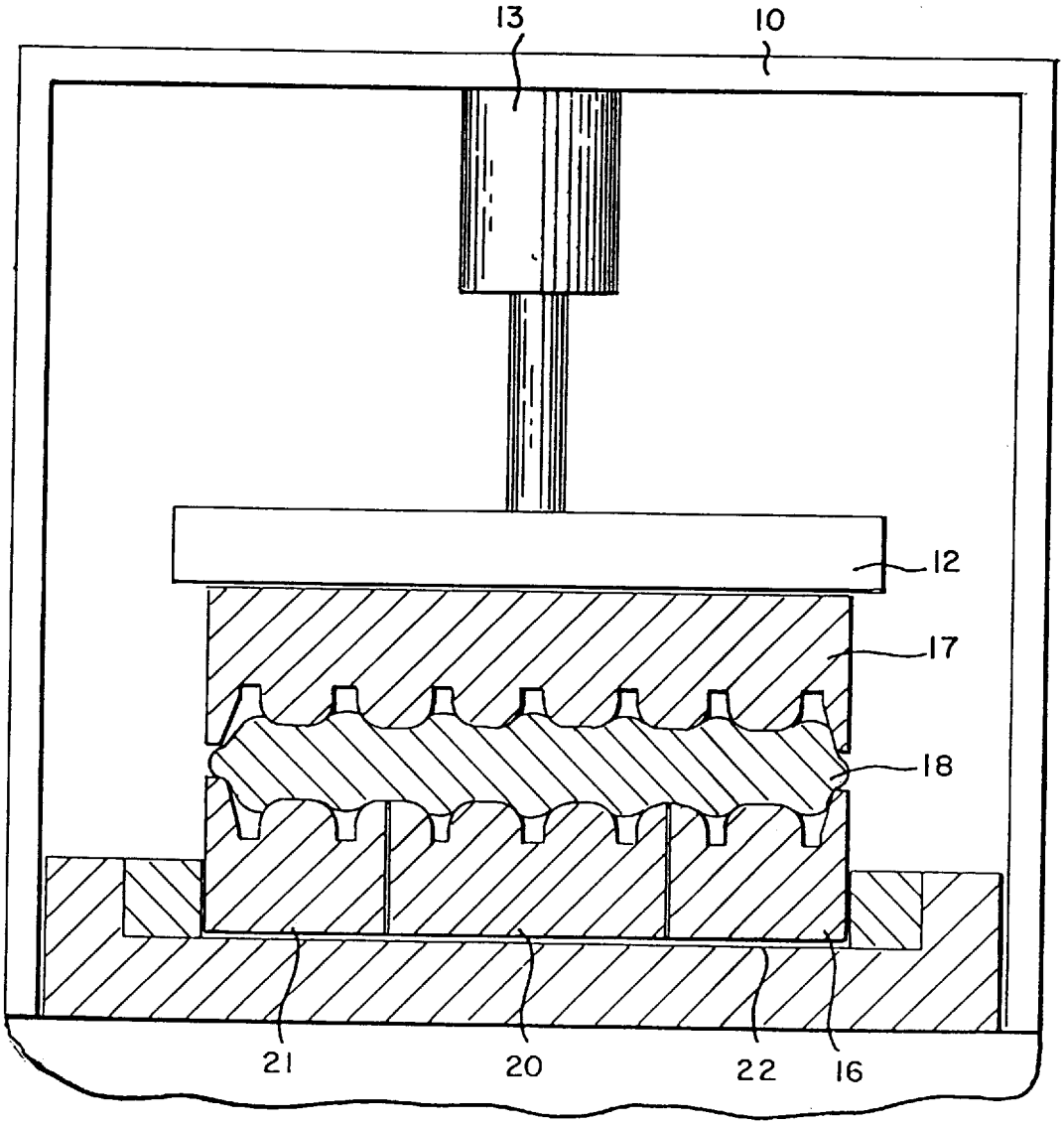
FIG. 2 is a view of the forging system shown in FIG. 1 in which the workpiece has been exposed to an initial rough forging.

FIG. 2 shows the result of a first forging step in which the workpiece 18 incurs the maximum force of the forging system 10 the workpiece is only forged into a rough shape because the plan area of the workpiece is sufficiently large that, the entire force of the press is not sufficient to close the dies and to achieve complete fill of the die impressions or cavities.

Figure 3:
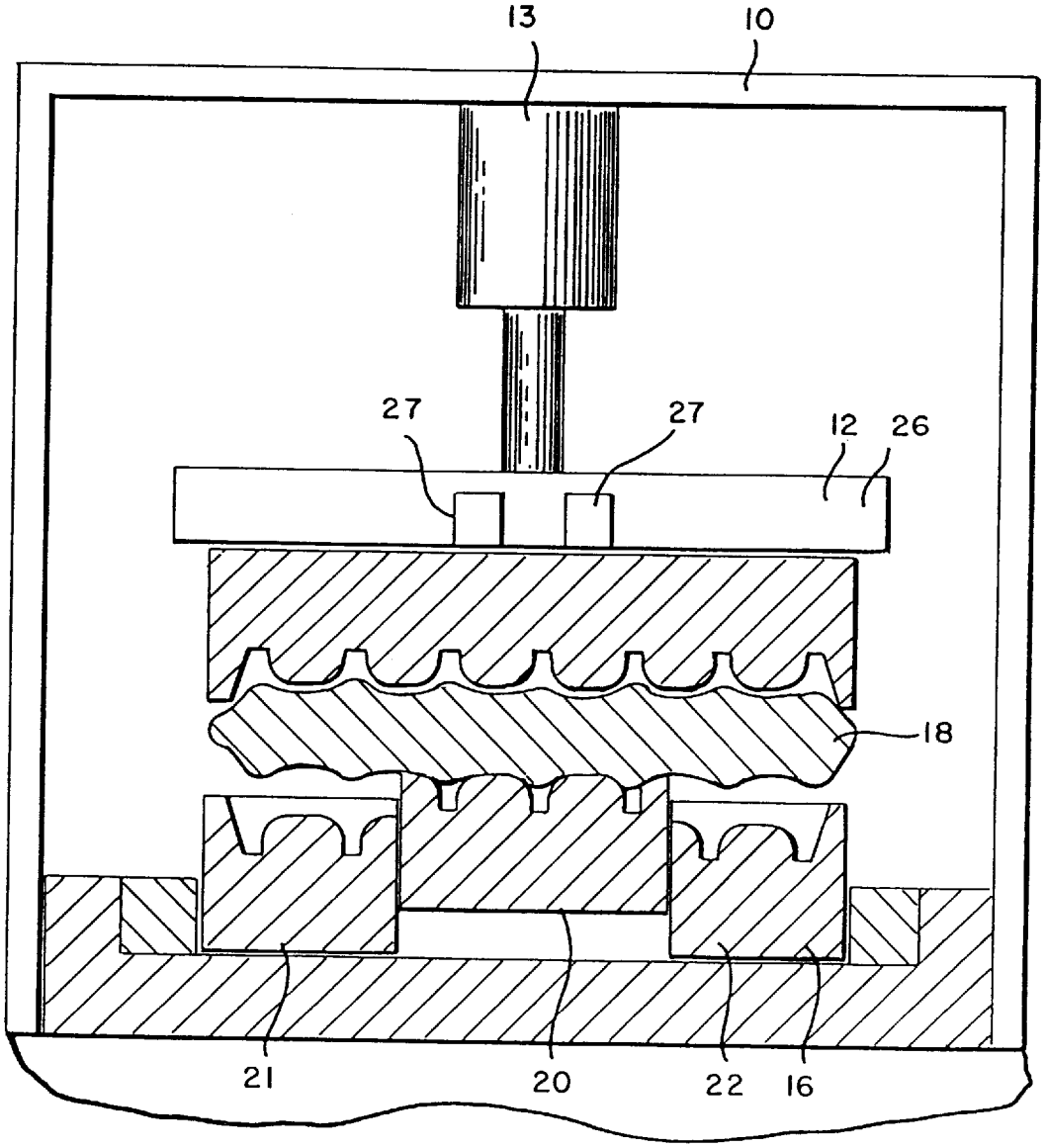
FIG. 3 is a view of the forging press of FIG. 1 in which the central segment of the segmented die has been lifted.

FIG. 3 is a schematic representation of a step by which a lifting means 26 is used to lift the central segment 20 of the segmented die 16 upwardly with respect to the lateral segments 21 and 22. As presently practiced, the central segment 20 would be connected to the first or movable die bed 12 by means of straps 27 partially shown in the unsectioned part of the figure and adapted to connect the moveable die 12 to the central segment 20. The lift capability lifts the segment away from the segmented die holder 15. As the central segment 20 moves upward and away from the segmented die holder 15, a space is formed between central segment 20, the segmented die holder 15, and the lateral segments 21 and 22. The space extends through the lower die assembly and forms an access window at the front and an access window at the back of the lower die assembly. These access windows allow access from the outside of the forging press to the space between the central segment 20, the segmented die holder 15, and the lateral segments 21 and 22. This access allows an advancement means 28 (discussed below) to be inserted and removed from the space while the central segment 20 is in the position shown in FIG. 3, without a major disassembly of the lower die assembly.

FIG. 3 shows the process of lifting the central segment 20 being carried out with the workpiece 15 still in the die cavity. This embodiment is possible if the process of repositioning the segments of the segmented die can be carried out relatively quickly. In practice, however, it is often the case that the process of repositioning the die segments requires so much time that it is necessary to remove the workpiece from the die cavity and place it in the oven to bring it back up to appropriate working temperature. After the die segments are repositioned, then the workpiece will be returned to the die cavity for further processing.

Figure 4:
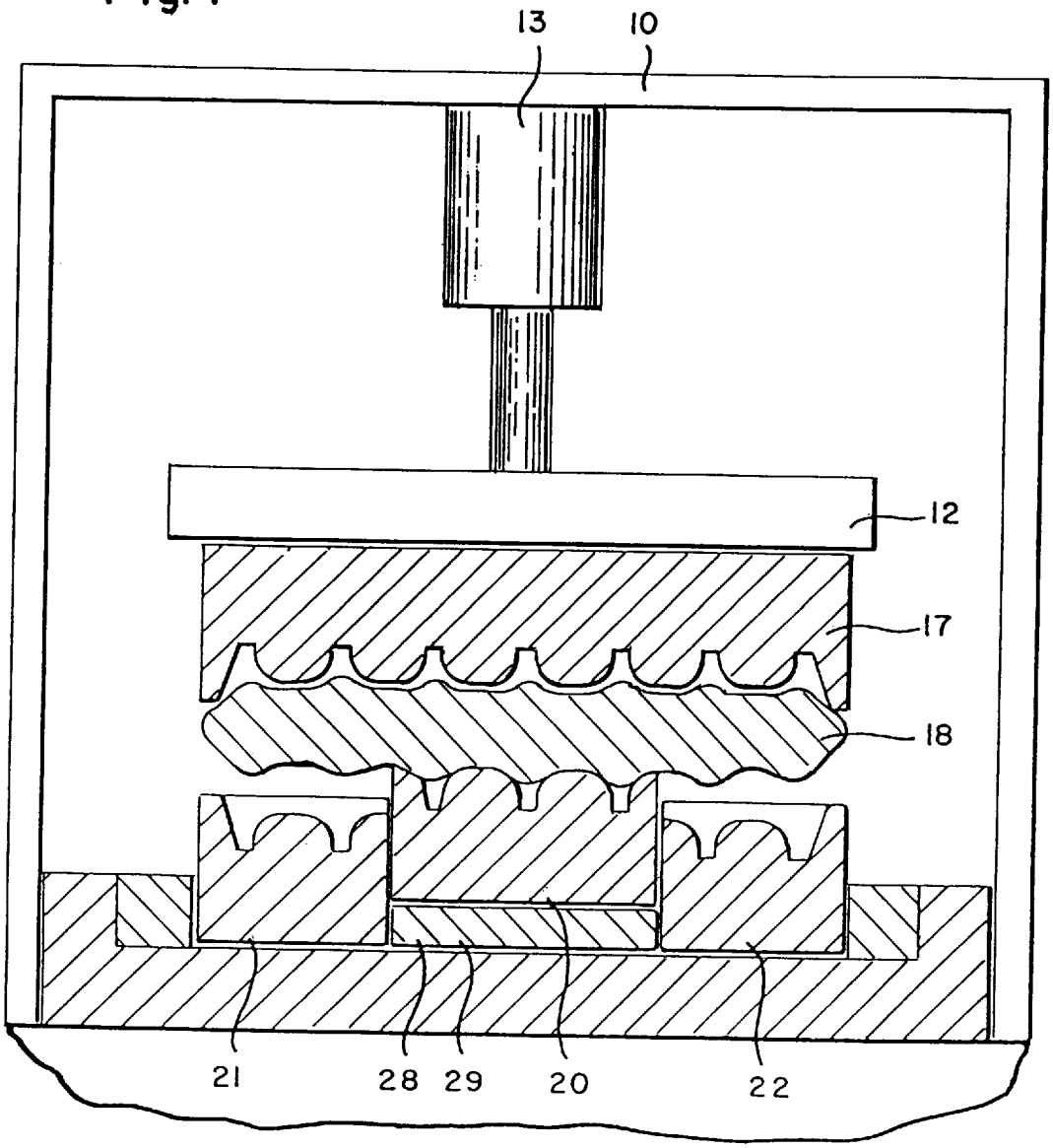
FIG. 4 is a view of the forging system shown in FIG. 1 in which a spacer block has been placed underneath the central segment of the segmented die.

FIG. 4 shows an advancement means 28. In this embodiment, it is a solid spacer block 29, which is placed under the central segment 20 in order to support it in its position in advance along the forging axis and direction of the lateral die segments 21 and 22.

Figure 5:
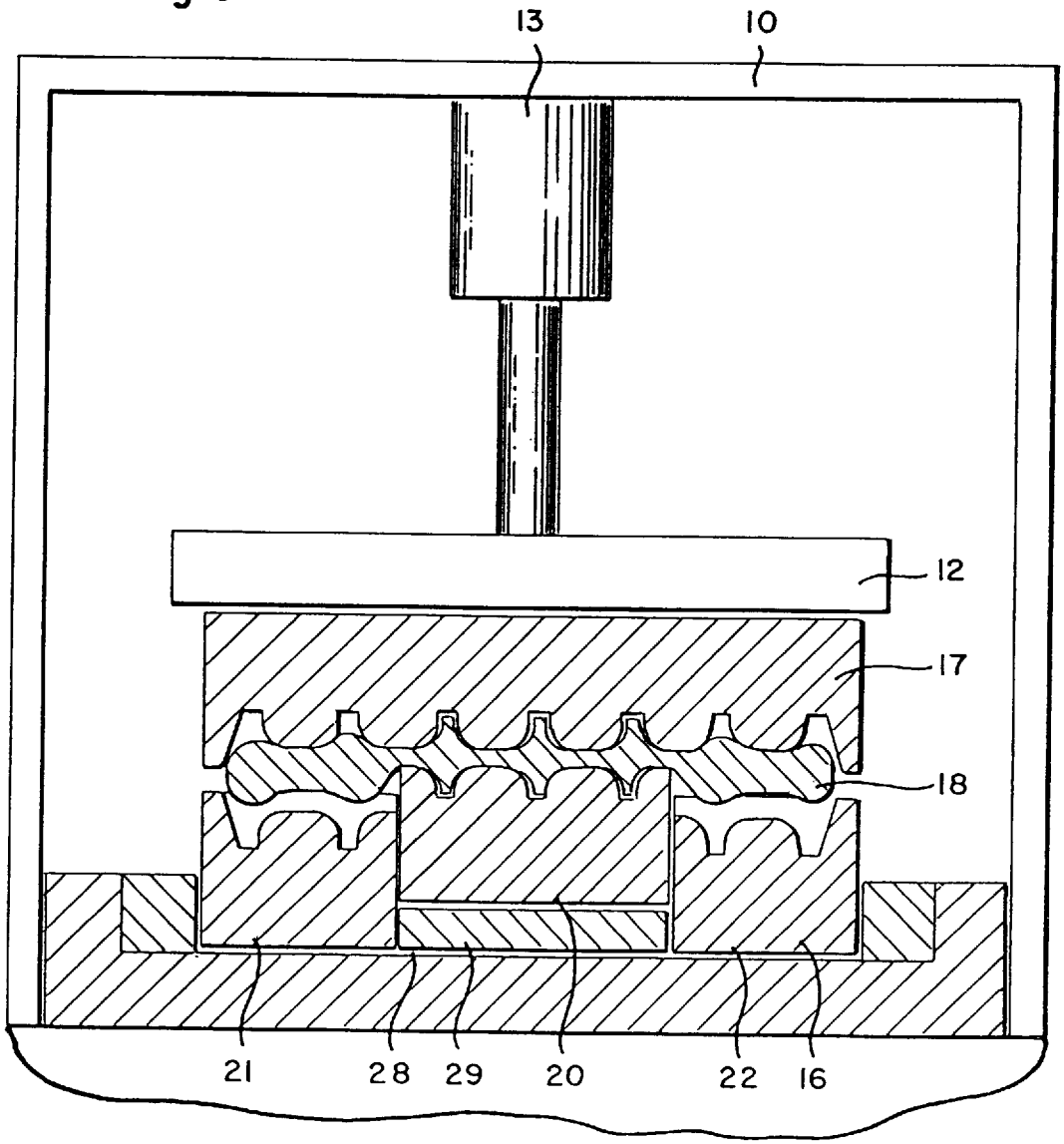
FIG. 5 is a view of the forging system shown in FIG. 1 in which forging between the non-segmented die and the central segment of the segmented die is carried out.

FIG. 5 shows the forging process carried out on the segmented die 16 with the central segment 20 advanced. The plan area of the central segment of the die is selected so that the maximum force available from the forging press 10 is sufficient to carry out a complete filling of that portion of the die cavity associated with the central segment of the segmented die. The central segmented die acts as the primary forging agent and acts only on sufficient plan area of the workpiece 18 so that the full forging process can be accomplished on that portion of the workpiece.

Because the lateral segments 21 and 22 of the segmented die 16 are recessed from the working face of the central segment 20, the lateral segments 21 and 22 act as secondary forging agents. This secondary forging action may include simply passive containment of the lateral portions of the workpiece, or may include simultaneous lateral support of the lateral portions of the workpiece to prevent bending of the workpiece at the boundaries of the central segment in reaction to the forging process, or may include some reduced level of actual forging activity. In the second and third instance noted above, that aspect of the secondary forging agent would reduce the effective force available to be applied to the central portion by means of the primary forging agent or central segment 20.

The role of the secondary forging agent in the process of the present invention can be optimize by selecting the amount of advancement of the primary forging agent accomplished by the advancement means. In this case, the advancement would be determined by the thickness of the spacer along the forging axis. The optimization would generally have to be accomplished for each desired workpiece shape and would be a function of the plan area of the central segment and the lateral segment pairs.

In a situation involving a typical titanium major structural element for a high performance aircraft, a spacer thickness of one half inch was found to be optimum. When spacers of less than one half inch were employed, the secondary forging action of the retarded segments became so significant that it impacted on the primary forging agent's action. When the spacer was greater than half inch and more specifically one inch, the lateral portions of the workpiece were bent during the forging process to an unexceptable degree.

Figure 6:
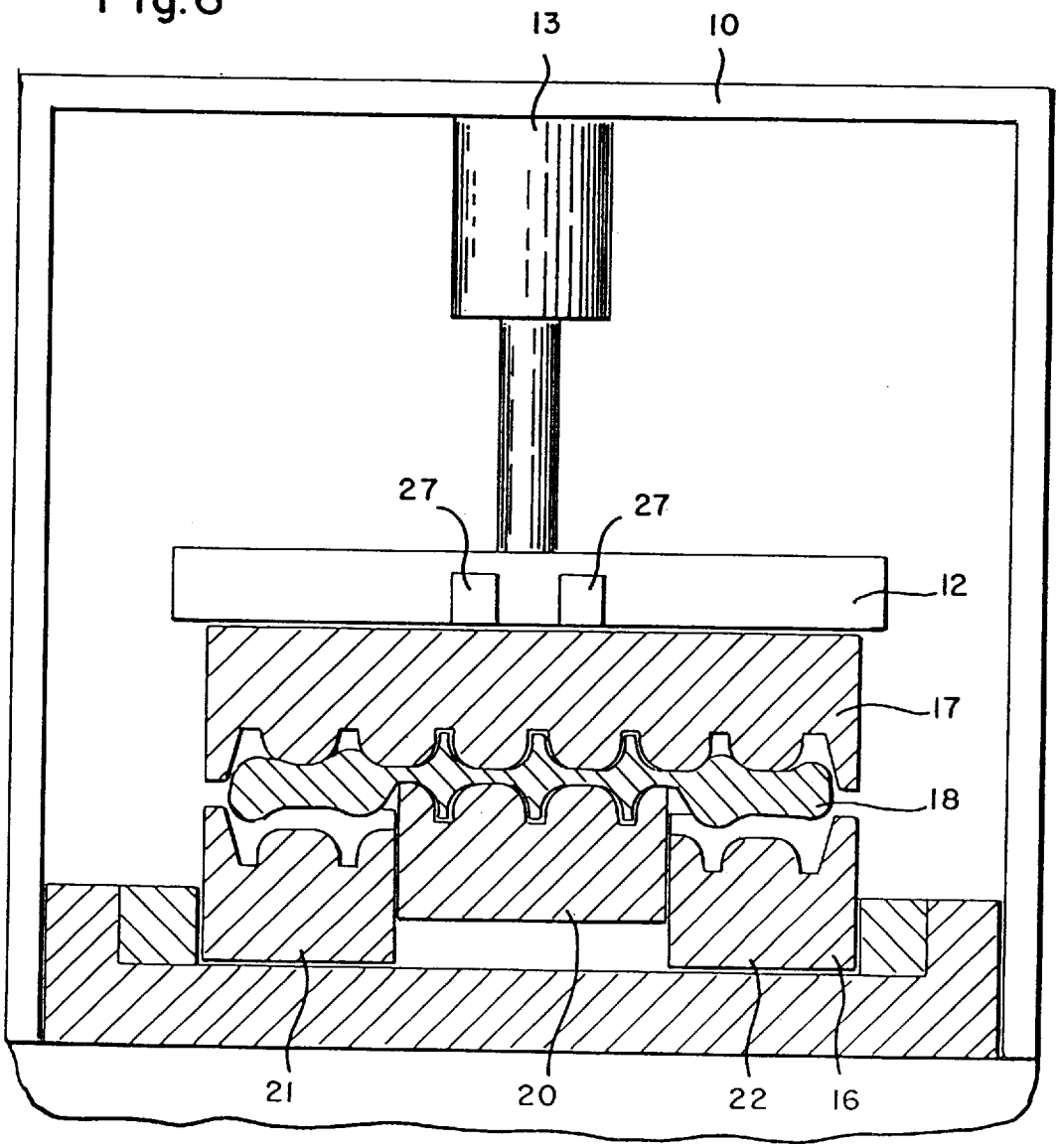
FIG. 6 is a view of the forging system shown in FIG. 1 in which the central segment is lifted and the spacer block removed.

FIG. 6 shows the process by which the central segment 20 is lifted again and the spacer 29 is removed from beneath it.

Figure 7:
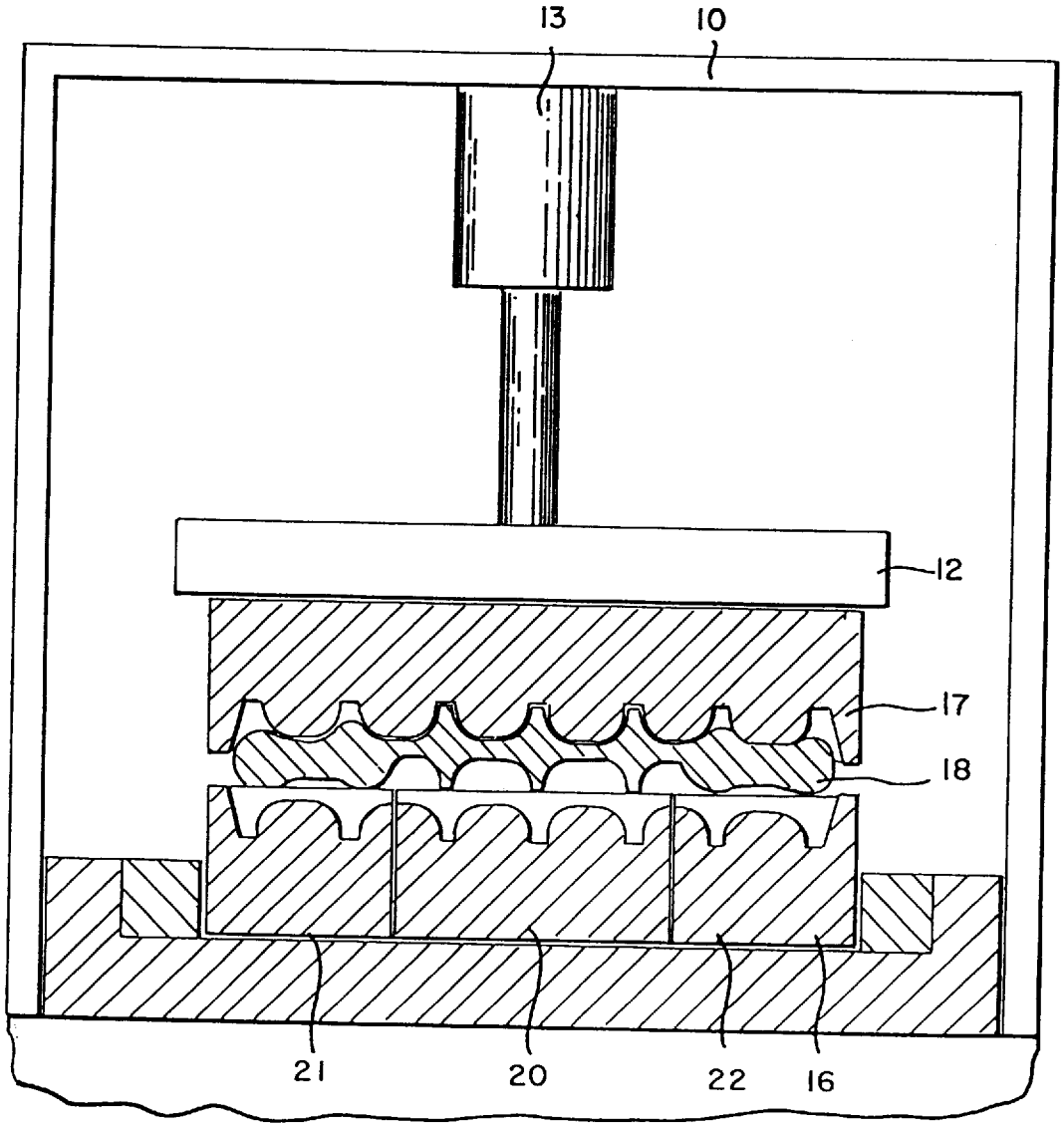
FIG. 7 is a view of the forging system shown in FIG. 1 in which the central segment is returned to its original position.

FIG. 7 shows the central segment 20 returned to its original position.

Figure 8:
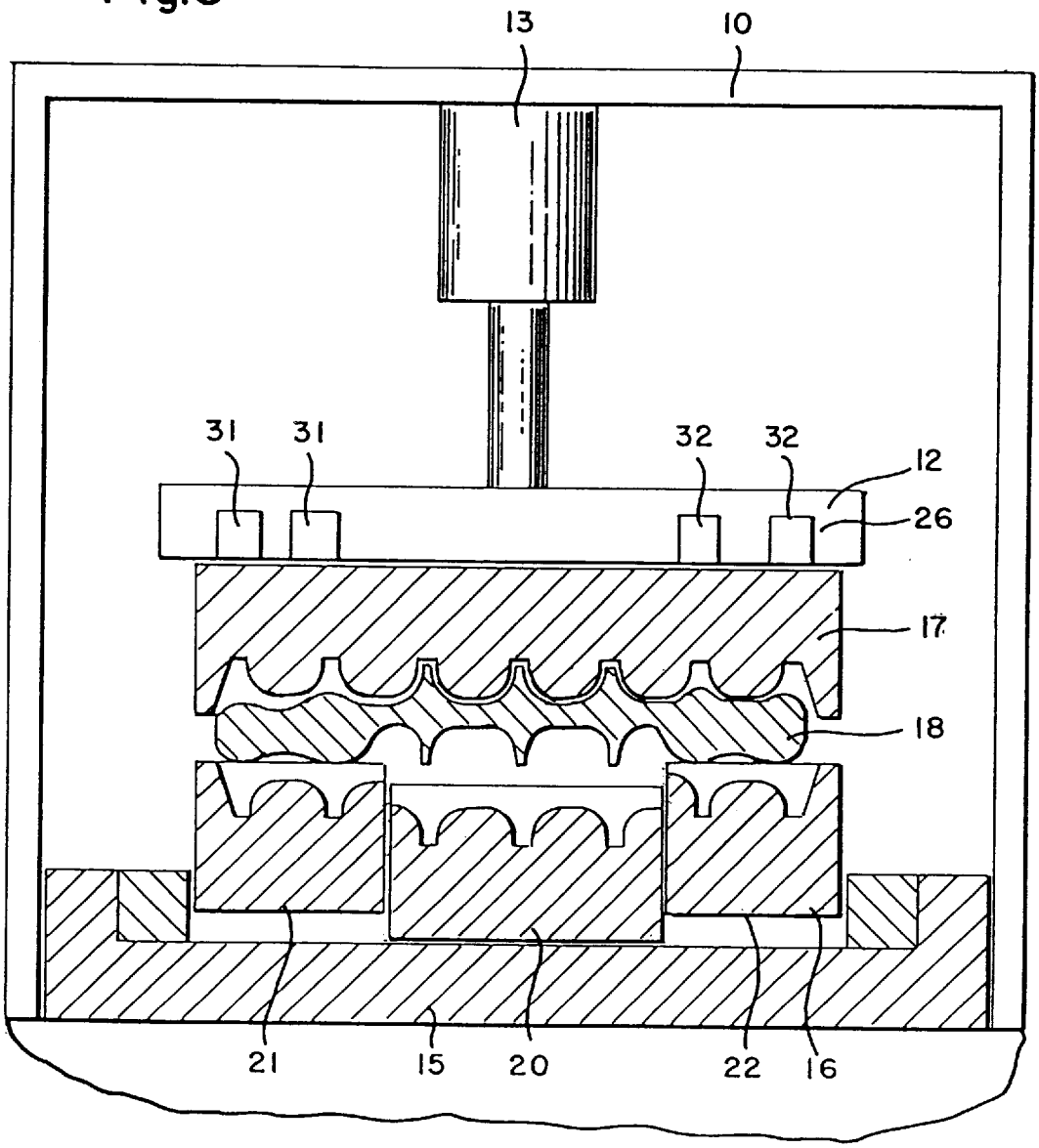
FIG. 8 is a view of the forging system shown in FIG. 1 in which the two lateral segments are lifted.

FIG. 8 shows the step in which the pair of lateral segments 21 and 22 are lifted from the segmented die holder 15 by the lifting means 26. In the present embodiment, the lifting means 26 is carried out by connecting the movable or second die bed 12 to the lateral segments 21 and 22 by means of straps 31 and 32. As the lateral segments 21 and 22 move upward and away from the segmented die holder 15, two spaces are formed between central segment 20, the segmented die holder 15, the lateral segments 21 and 22, and locks 24 and 25. The spaces extend through the lower die assembly and each forms an access window at the front and an access window at the back of the lower die assembly. These access windows allow access from the outside of the forging press to the spaces between the central segment 20, the segmented die holder 15, the lateral segments 21 and 22, and the locks 24 and 25. This access allows an advancement means 28 to be inserted and removed from the space while the lateral segments 21 and 22 are in the positions shown in FIG. 8, with out a major disassembly of the lower die assembly.

Figure 9:
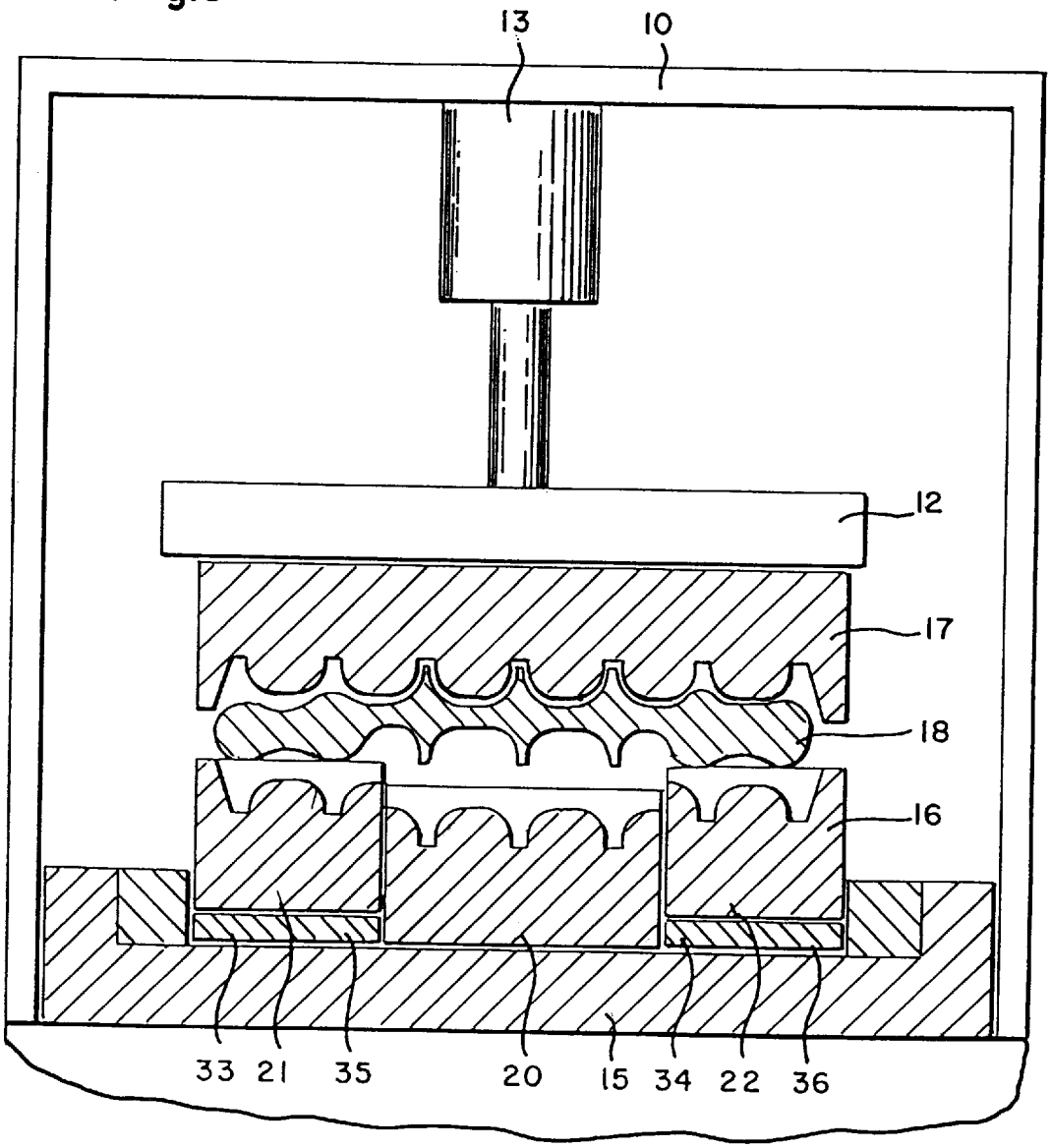
FIG. 9 is a view of the forging system shown in FIG. 1 in which spacer blocks are placed underneath the two lateral segments.

FIG. 9 the advancement means 33 and 34 which, in the preferred embodiment are spacers 35 and 36. They are positioned under each of the lateral segments 21 and 22 to lock them into a position in advance of the central segment 20.

Figure 10:
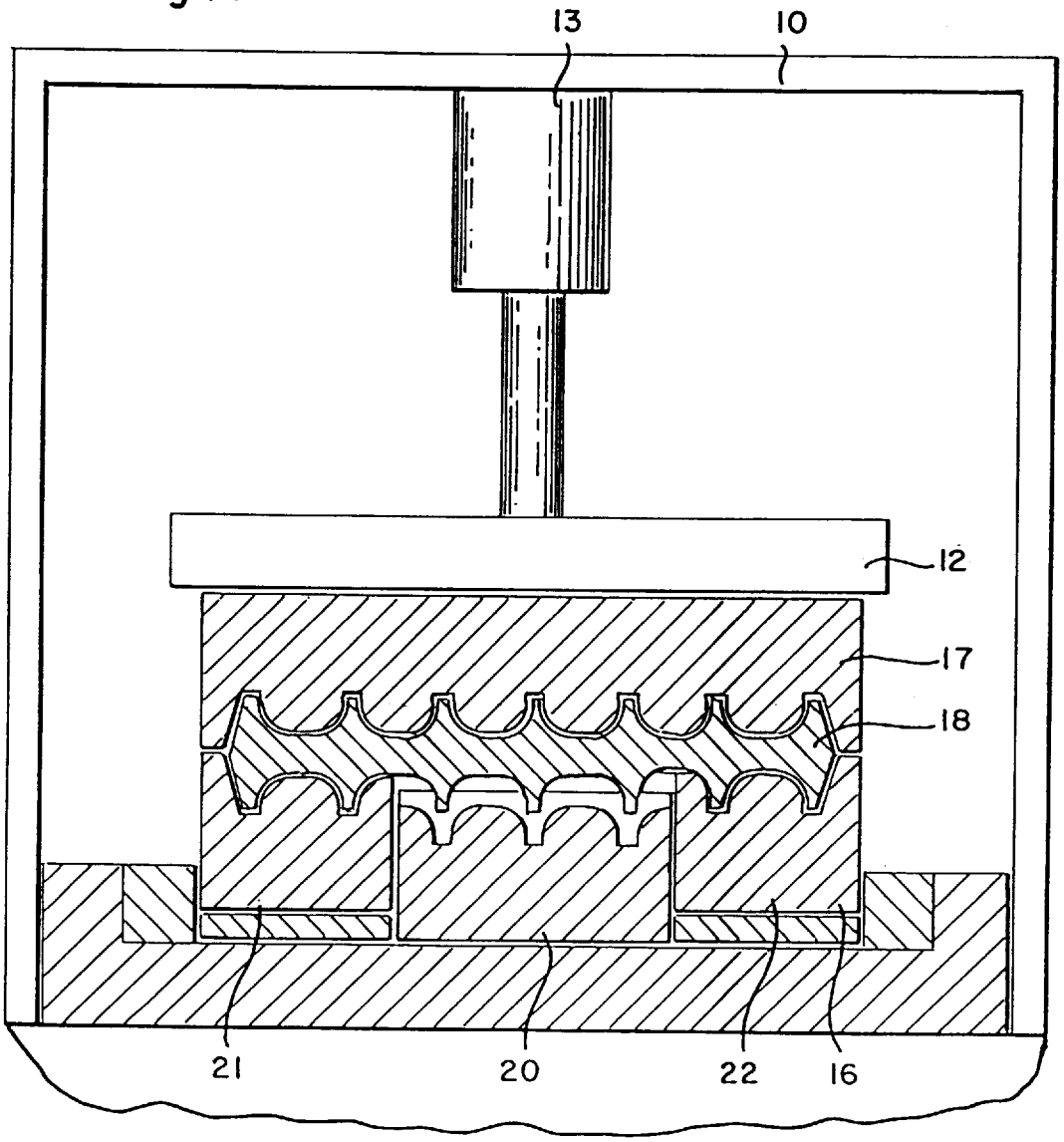
FIG. 10 is a view of the forging system shown in FIG. 1 in which forging is accomplished between the non-segmented and the two advanced lateral die segments of the segmented die.

FIG. 10 shows the forging of the lateral portions of the workpiece 18 between the non-segmented die 17 and the lateral segments 21 and 22 of the segmented die 16.

Generally, the combined plan area of the lateral segments 21 and 22 would be equal to the plan area of the central segment 20. In practice, the area of the lateral segments 21 and 22 can be slightly larger than the plan area of the central segment 20 because the central segment is generally not required to provide support to the workpiece and thereby reduce some of the force of the forging press to the same extent as has been found optimal in the step where the central segment is the primary forging agent.

Figure 11:
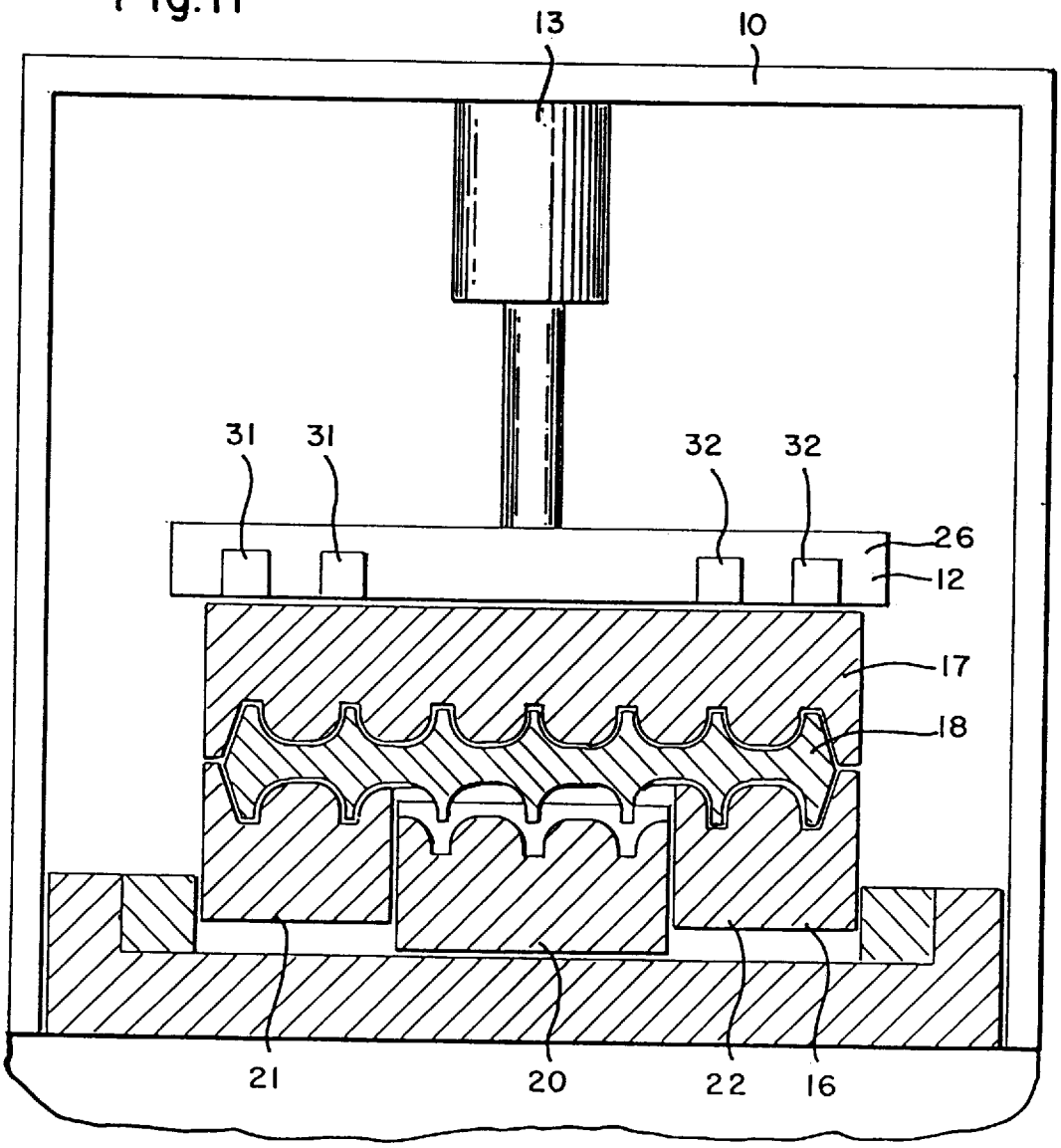
FIG. 11 is a view of the forging system shown in FIG. 1 in which the lateral segments are lifted.

FIG. 11 shows the lifting means 26 employed to lift the lateral segments 21 and 22 and shows the removal of the spacers 35 and 36.

Figure 12:
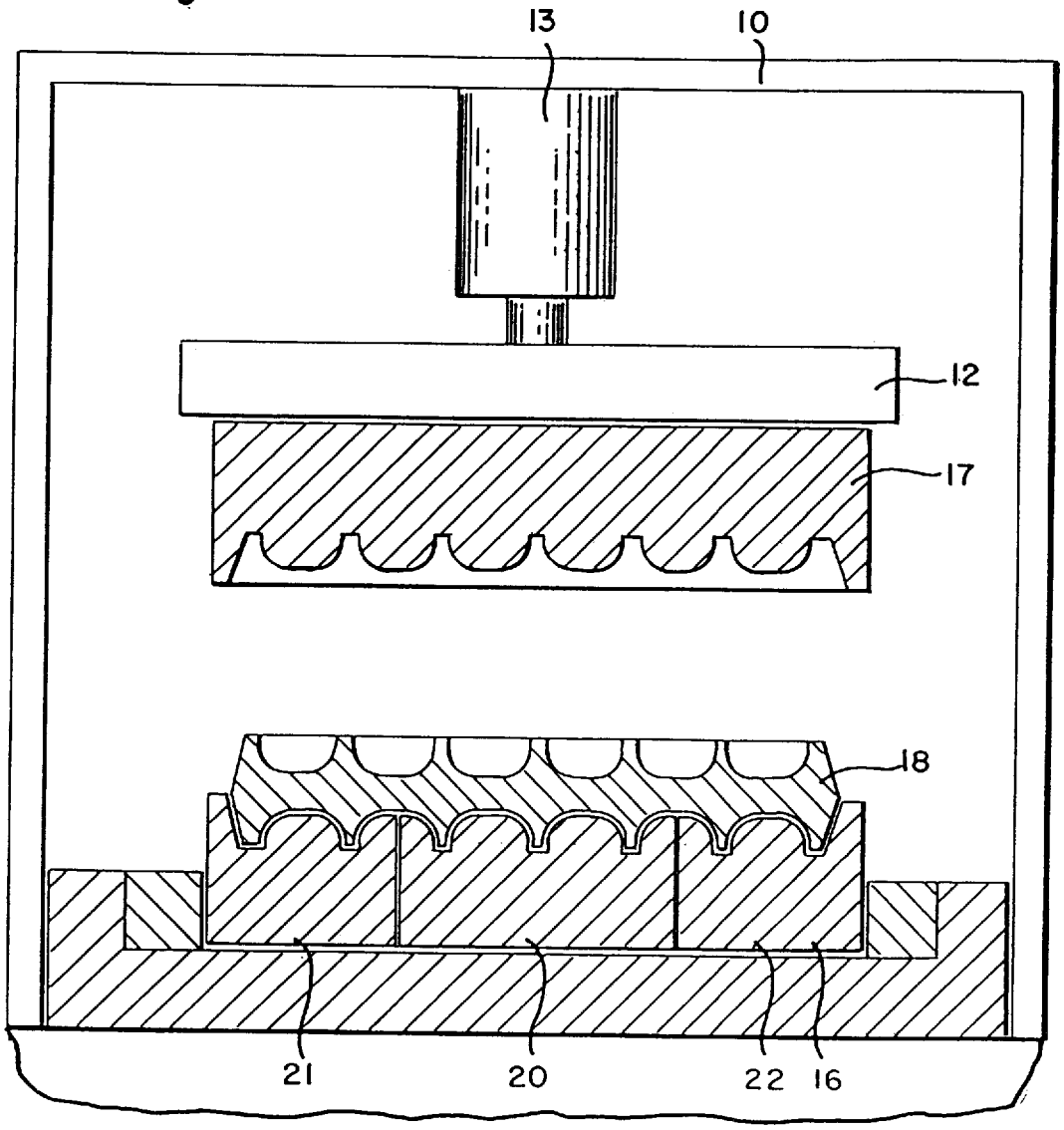
FIG. 12 is a view of the forging system shown in FIG. 1 in which the segmented die is returned to its original condition.

FIG. 12 shows the segmented die segments 20, 21, and 22 returned to their original non-advanced position.

Figure 13:
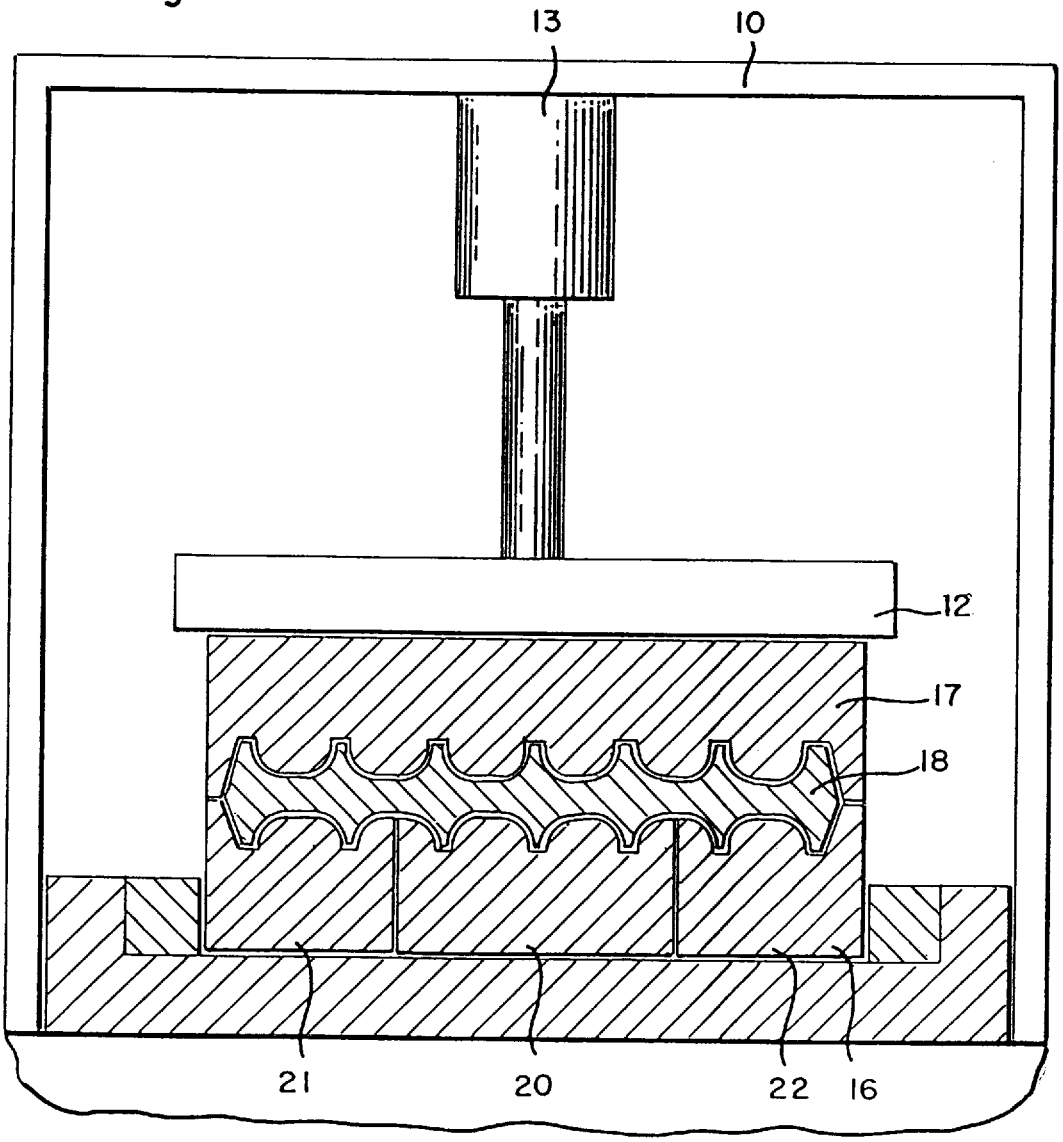
FIG. 13 is a view of the forging system shown in FIG. 1 in which a final press of the workpiece is carried out.

FIG. 13 shows a final forging step in which the workpiece 18 is given a final press to achieve near-net shape.

Figure 14:
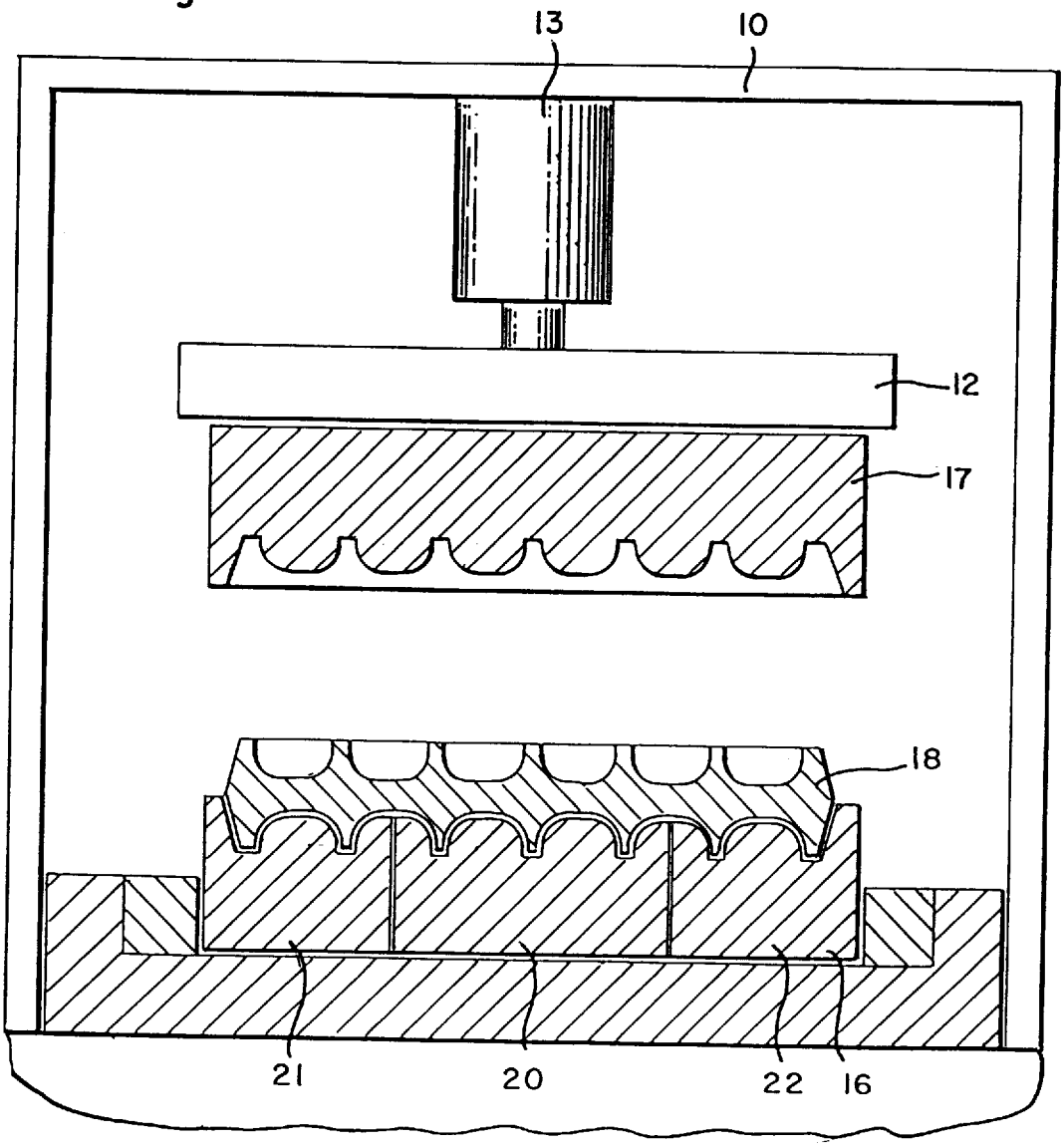
FIG. 14 is a view of the forging system shown in FIG. 1 in which the finished workpiece is exposed in the open dies.

FIG. 14 shows the finished workpiece and the dies open.

With the set up shown in the preferred embodiment, it is possible to forge a workpiece having a plan area slightly less than twice the size that would normally be forgable in a press of a given force capacity. It will be understood by those skilled in the art that the concept of the pair of lateral segments can be extended to a second pair of lateral segments outward of each of the first set of lateral segments. In general, it has been found preferable to design the segments so that in each step in the stepped, segmented-die forging process, the primary forged area of the workpiece is symmetrical about the center of mass of the workpiece and about the forging axis of the forging system. Thus, if a central segment and two pairs of lateral segments were employed, the effective capacity of the forging press could be nearly tripled.

As mentioned above, one of the significant aspects of the design of the equipment to carry out the process of this invention involves the selection of the thickness of the spacer under the central segment in order to achieve simultaneous lateral support of the lateral elements of the workpiece. Undesirable bending of the workpiece during the steps of the process can be minimized by designing the degree of advancement of the segments so that, while the primary forging agent is carrying out its major deformation activity and absorbing the major portion of the force capacity of the press, the retarded segments are providing sufficient force on the workpiece so that downward bending of the lateral segments of the workpiece is minimized. It would normally be assumed that the minimal force absorbed by the support action of the secondary forging elements could not be achieved with a fixed advancement between the primary forging agent and the retarded segments. Once the retarded segments reached the workpiece, it would be expected that the force that would be absorbed by the secondary forging agent and therefore which would be not available to the primary forging agent would increase very rapidly. It has been found, in practice, however, that the contact interaction between the sloped sides of the workpiece ribs and the slope sides of the rib cavities in the mold the secondary forging elements surprisingly allows a minimal holding force between the secondary forging elements and the workpiece during a significant portion of the travel of the dies. By carefully selecting the angles of the ribs of the workpiece and the thickness of the spacer, the deformation and forging action of the primary forging agent can be fully achieved while the secondary forging agent imposes a minimal holding force on the workpiece over the travel of the segmented die. This surprising result allows the stepped, segmented-die process of the present invention to be carried out to levels of effectiveness which could not have been predicted or expected.

It is obvious that minor changes may be made in the form and construction of the invention without departing from the material spirit thereof. It is not, however, desired to confine the invention to the exact from herein shown and described, but it is desired to include all such as properly come within the scope claimed.

The invention having been thus described, what is claimed as new and desired to secure by Letters Patent is:

1. A method for enhancing the performance, on a workpiece having a first portion and a second portion, of a forging press and in which the shape and thickness of the workpiece are significantly altered and in which grain flow and flow lines are formed, that is, patterns revealable by macroetching in the workpiece resulting from elongation of non-homogeneous constituents and the grain structure of the workpiece in the direction of working during forming, the press having a first die bed and a second die bed, comprising steps of:

(a) installing, in the press, a closed die set having a first impression die mounted on the first die bed, and a second impression die mounted on the second die bed, said first die being divided into at least two segments, a first segment and a second segment, the second die being unsegmented, (b) providing a first advancement means comprising a first spacer between said first die bed and said first segment and employing the first advancement means to advance the first segment from a first, normal, position to a second position ahead of the second segment, (c) placing the workpiece between the dies, (d) carrying out a first closed die forging operation on the workpiece, so that the first segment and the unsegmented die are the primary forging agent and act on the said first portion, the thickness of said first spacer being such that the second segment provides the minimum force required to provide passive containment of the workpiece, (e) opening said press and removing said first spacer, (f) returning the first segment to its normal position, and (g) conducting a second closed die forging operation on the workpiece, so that the second segment and the unsegmented die are the primary forging agents and act on said second portion, the thickness of said first spacer having been such that the first segment provides the minimum force required to provide passive containment of the workpiece.

2. A method as recited in claim 1, wherein, in step (d) the second segment provides the minimum force required to restrain movement of the workpiece, and in step (g) the first segment provides the minimum force required to restrain movement of the workpiece.

3. A method as recited in claim 1, wherein, in step (d) the second segment provides the minimum force required to prevent bending of the workpiece, and in step (g) the first segment provides the minimum force required to prevent bending of the workpiece.

4. A method as recited in claim 1, wherein the "spacers" are "solid spacers".

5. A method as recited in claim 4, wherein, in step (d) the second segment provides the minimum force required to restrain movement of the workpiece, and in step (g) the first segment provides the minimum force required to restrain movement of the workpiece.

6. A method as recited in claim 4, wherein, in step (d) the second segment provides the minimum force required to prevent bending of the workpiece, and in step (g) the first segment provides the minimum force required to prevent bending of the workpiece.

7. A method as recited in claim 1, wherein the "spacers" are "spacer blocks".

8. A method as recited in claim 7, wherein, in step (d) the second segment provides the minimum force required to restrain movement of the workpiece, and in step (g) the first segment provides the minimum force required to restrain movement of the workpiece.

9. A method as recited in claim 7, wherein, in step (d) the second segment provides the minimum force required to prevent bending of the workpiece, and in step (g) the first segment provides the minimum force required to prevent bending of the workpiece.

10. A method as recited in claim 1, comprising fact that, the "spacers" are "solid blocks".

11. A method as recited in claim 10, wherein, in step (d) the second segment provides the minimum force required to restrain movement of the workpiece, and in step (g) the first segment provides the minimum force required to restrain movement of the workpiece.

12. A method as recited in claim 10, wherein, in step (d) the second segment provides the minimum force required to prevent bending of the workpiece, and in step (g) the first segment provides the minimum force required to prevent bending of the workpiece.

13. A method as recited in claim 1, comprising fact that, the "spacers" are "solid spacer blocks".

14. A method as recited in claim 13, wherein, in step (d) the second segment provides the minimum force required to restrain movement of the workpiece, and in step (g) the first segment provides the minimum force required to restrain movement of the workpiece.

15. A method as recited in claim 13, wherein, in step (d) the second segment provides the minimum force required to prevent bending of the workpiece, and in step (g) the first segment provides the minimum force required to prevent bending of the workpiece.

16. A method as recited in claim 1, wherein step (f) is replaced by the following new step (f):

(f) providing a second advancement means comprising a second spacer between said first die bed and said second segment and employing the second advancement means to advance the second segment ahead of the first segment, and step (g) is replaced by the following new step (g):

(g) conducting a second closed die forging operation on the workpiece, so that the second segment is a primary forging agent and acts on the said second portion, the thickness of said second spacer being such that the first segment provides the minimum force required to provide passive containment of the workpiece.

17. A method as recited in claim 16, wherein, in step (d) the second segment provides the minimum force required to restrain movement of the workpiece, and in step (g) the first segment provides the minimum force required to restrain movement of the workpiece.

18. A method as recited in claim 16, wherein, in step (d) the second segment provides the minimum force required to prevent bending of the workpiece, and in step (g) the first segment provides the minimum force required to prevent bending of the workpiece.

19. A method as recited in claim 16, wherein the "spacers" are "solid spacers".

20. A method as recited in claim 19, wherein, in step (d) the second segment provides the minimum force required to restrain movement of the workpiece, and in step (g) the first segment provides the minimum force required to restrain movement of the workpiece.

21. A method as recited in claim 19, wherein, in step (d) the second segment provides the minimum force required to prevent bending of the workpiece, and in step (g) the first segment provides the minimum force required to prevent bending of the workpiece.

22. A method as recited in claim 16, wherein the "spacers" are "spacer blocks".

23. A method as recited in claim 22, wherein, in step (d) the second segment provides the minimum force required to restrain movement of the workpiece, and in step (g) the first segment provides the minimum force required to restrain movement of the workpiece.

24. A method as recited in claim 22, wherein, in step (d) the second segment provides the minimum force required to prevent bending of the workpiece, and in step (g) the first segment provides the minimum force required to prevent bending of the workpiece.

25. A method as recited in claim 16, wherein the "spacers" are "solid blocks".

26. A method as recited in claim 25, wherein, in step (d) the second segment provides the minimum force required to restrain movement of the workpiece, and in step (g) the first segment provides the minimum force required to restrain movement of the workpiece.

27. A method as recited in claim 25, wherein, in step (d) the second segment provides the minimum force required to prevent bending of the workpiece, and in step (g) the first segment provides the minimum force required to prevent bending of the workpiece.

28. A method as recited in claim 16, wherein the "spacers" are "solid spacer blocks".

29. A method as recited in claim 28, wherein, in step (d) the second segment provides the minimum force required to restrain movement of the workpiece, and in step (g) the first segment provides the minimum force required to restrain movement of the workpiece.

30. A method as recited in claim 28, wherein, in step (d) the second segment provides the minimum force required to prevent bending of the workpiece, and in step (g) the first segment provides the minimum force required to prevent bending of the workpiece.

31. A method as recited in claim 16, wherein prior to step (b), a preliminary blocking closed die forging process is carried out on the workpiece with both the first and second segments in direct contact with the first die bed.

32. A method as recited in claim 16, wherein the forging press has a forging axis, and said second segment comprises two lateral portions positioned on opposite sides of the first segment, and the first segment and the two portions of the second segment are symmetrical about the forging axis, so that the forging forces on each side of the forging axis are always in balance during the forging process and do not impose torque on the first die bed during the forging process.

33. A method as recited in claim 1, wherein, prior to step (b), a preliminary blocking closed die forging process is carried out on the workpiece with both the first and second segments in direct contact with the first die bed.

34. A method as recited in claim 1, wherein the forging press has a forging axis, and said second segment comprises two lateral portions positioned on opposite sides of the first segment, and the first segment and the two portions of the second segment are symmetrical about the forging axis, so that the forging forces on each side of the forging axis are always in balance during the forging process and do not impose torque on the first die bed during the forging process.

35. A forging press for forging a workpiece having a first portion and a second portion, in which the shape and thickness of the workpiece are significantly altered and in which grain flow and flow lines are formed, that is, patterns revealable by macroetching in the workpiece resulting from elongation of non-homogeneous constituents and the grain structure of the workpiece in the direction of working during forming, the press having a first die bed and a second die bed, comprising:

(a) a closed die set having a first impression die mounted on the first die bed, and a second impression die mounted on the second die bed, said first die being divided into at least two segments, a first segment and a second segment, said second die being unsegmented, and (b) a first advancement means comprising a first spacer removably located between said first die bed and said first segment the first advancement means adapted to advance the first segment ahead of the second segment, the thickness of said first spacer being such that the second segment and the unsegmented die provide the minimum force required to provide passive containment of the workpiece.

36. A forging press as recited in claim 35, further comprising:

(c) a second advancement means comprising a second spacer removably located between said first die bed and said second segment, the second advancement means adapted to advance the second segment ahead of the first segment, the thickness of said second spacer being such that the first segment and said unsegmented die provides the minimum force required to provide passive containment of the workpiece.

37. A forging press as recited in claim 35, wherein said first segment die has a peripheral edge which is in a plane parallel to the first die bed and which surrounds the first segmented die, and the first and second die segments of the first die are separated by a separation surface having a first end positioned at the said peripheral edge, and a second end positioned at the said peripheral edge, the separation surface being so adapted that, when one of the die segments is advanced, space is formed between the die segment and the die bed, and an access window is formed on the peripheral edge, which window is adapted to allow access from outside of the die, through the peripheral edge, into the said space, and to allow a spacer to be inserted into and extracted from said space.

38. A forging press as recited in claim 37, wherein said first segmented die has a peripheral edge which is in a plane parallel to the first die bed and which surrounds the first segmented die, and the first and second die segments of the first die are separated by a separation surface having a first end positioned at the said peripheral edge, and a second end positioned at the said peripheral edge, and a segmented-die holder and at least two locks are provided and the holder is adapted to hold the locks against the peripheral edge of the segmented die and to prevent the die segments from separating from one another at the separation surface during the forging operation.

39. A forging press as recited in claim 35, wherein said first segmented die has a peripheral edge which is in a plane parallel to the first die bed and which surrounds the first segmented die, and the first and second die segments of the first die are separated by a separation surface having a first end positioned at the said peripheral edge, and a second end positioned at the said peripheral edge, and a segmented-die holder and at least two locks are provided and the holder is adapted to hold the locks against the peripheral edge of the segmented die and to prevent the die segments from separating from one another at the separation surface during the forging operation.

40. A forging press as recited in claim 35, wherein said second segment comprises two lateral portions approximately equal in combined forging area to that of said first segment.

41. A forging press as recited in claim 35, wherein the forging press has an forging axis, and said second segment comprises two lateral portions positioned on opposite sides of the first segment, and the first segment and the two portions of the second segment are symmetrical about the forging axis.

* * * * *